US011248498B2

(12) United States Patent
Wilson et al.

(10) Patent No.: US 11,248,498 B2
(45) Date of Patent: Feb. 15, 2022

(54) SYSTEM AND METHOD FOR ASSEMBLING AND SHIPPING STEAM TURBINE

(71) Applicant: GENERAL ELECTRIC COMPANY, Schenectady, NY (US)

(72) Inventors: Zachary Lawrence Wilson, Glenville, NY (US); Kevin Joseph Barb, Halfmoon, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/846,621

(22) Filed: Apr. 13, 2020

(65) Prior Publication Data

US 2021/0317756 A1 Oct. 14, 2021

(51) Int. Cl.
*F01D 25/28* (2006.01)

(52) U.S. Cl.
CPC ..... *F01D 25/285* (2013.01); *F05D 2230/10* (2013.01); *F05D 2230/60* (2013.01); *F05D 2240/90* (2013.01)

(58) Field of Classification Search
CPC .... F01D 25/28; F01D 25/285; F05D 2230/60; F05D 2240/90
See application file for complete search history.

(56) References Cited

U.S. PATENT DOCUMENTS 6,793,458 B2 * 9/2004 Kawai ..... F01D 25/28 415/213.1
7,329,098 B2 2/2008 Burdgick
2006/0251514 A1 11/2006 Burdgick

FOREIGN PATENT DOCUMENTS

DE 3508926 A1 * 8/1986 ..... F01D 25/285

OTHER PUBLICATIONS

European extended search report of Application No. EP 21165700.2, dated Oct. 6, 2021; 7 pages.

* cited by examiner

*Primary Examiner* — Richard A Edgar
(74) *Attorney, Agent, or Firm* — Fletcher Yoder, P.C.

(57) ABSTRACT

A support system for assembling and shipping a steam turbine is provided that includes an annular support fixture configured to be coupled to a longitudinal end of a casing of the steam turbine. The annular support fixture includes a first protrusion that extends in an axial direction relative to a longitudinal axis of a rotor of the steam turbine between the rotor and the casing and that is configured to support the rotor in the radial direction. The annular support fixture includes a second protrusion, which extends in the radial direction toward a lateral surface of the rotor and which includes a surface configured to face the rotor in the axial direction. The support system includes a block configured to be disposed between the surface of the second protrusion and the rotor, such that the block blocks movement of the rotor in the axial direction during shipping of the steam turbine.

18 Claims, 9 Drawing Sheets

SYSTEM AND METHOD FOR ASSEMBLING AND SHIPPING STEAM TURBINE

BACKGROUND

The subject matter disclosed herein relates to steam turbines and, more particularly, to a support fixture for both shipping and building of a steam turbine.

Steam turbines include a rotor, which may be a shaft or drum, to which blades are attached. The assembly and shipping of steam turbines (e.g., turbine section including the rotor) may be both costly and time consuming. Further, during assembly and shipping, additional components (e.g., rigid shipping blocks, temporary bearings, etc.) may be utilized that later have to be removed upon final build at the end destination. In certain situations, the installation of rotor retention assemblies may occur via a blind assembly. In addition, the assembly and shipping configuration utilized may include clearances and gaps that lead to high impact loads (e.g., due to inertial forces) on the rotor during shipping, which result in wear. The removal of these additional components may involve breaching and subsequently resealing the steam turbine's pressure containment boundary.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In accordance with a first embodiment, a system is provided. The system includes a steam turbine module including a casing and a rotor disposed within the casing. The system also includes a support system for both assembling and shipping the steam turbine module. The support system includes a first annular support fixture coupled to a first longitudinal end of the casing. The first annular support fixture includes a first protrusion that extends in an axial direction relative to a longitudinal axis of the rotor between the rotor and the casing, wherein the first protrusion is configured to support the rotor in a radial direction relative to the longitudinal axis. The first annular support fixture also includes a second protrusion that extends in the radial direction toward a lateral surface of the rotor, wherein the second protrusion includes a first surface facing the rotor in the axial direction. The support system also includes a block disposed between the first surface of the second protrusion and the rotor, wherein the block is configured to block movement of the rotor in the axial direction during shipping of the steam turbine module.

In accordance with a second embodiment, a support system for both assembling and shipping a steam turbine module is provided. The support system includes a first annular support fixture configured to be coupled to a first longitudinal end of a casing of the steam turbine module. The first annular support fixture includes a first protrusion configured to extend in an axial direction relative to a longitudinal axis of a rotor of the steam turbine module between the rotor and the casing, wherein the first protrusion is configured to support the rotor in a radial direction relative to the longitudinal axis. The first annular support fixture also includes a second protrusion configured to extend in the radial direction toward a lateral surface of the rotor, wherein the second protrusion includes a first surface configured to face the rotor in the axial direction. The support system also includes a block configured to be disposed between the surface of the second protrusion and the rotor, wherein the block is configured to block movement of the rotor in the axial direction during shipping of the steam turbine module.

In accordance with a third embodiment, a method for assembling and shipping a steam turbine module is provided. The method includes coupling a first portion of a first annular support fixture to a first longitudinal end of a lower portion of a casing of the steam turbine module, wherein the first annular support fixture includes a first protrusion that is configured to extend in an axial direction relative to a longitudinal axis of a rotor of the steam turbine module between the rotor and the casing and a second protrusion that is configured to extend in a radial direction relative to the longitudinal axis toward a lateral surface of the rotor, wherein the second protrusion includes a first surface configured to face the rotor in the axial direction, and wherein the first protrusion is configured to support the rotor in the radial direction. The method also includes disposing a rotor of the steam turbine module within the lower portion of the casing. The method further includes disposing a first portion of a block between the first surface of the second protrusion and the rotor, wherein the first portion of the block is configured to block movement of the rotor in the axial direction during shipping of the steam turbine module.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
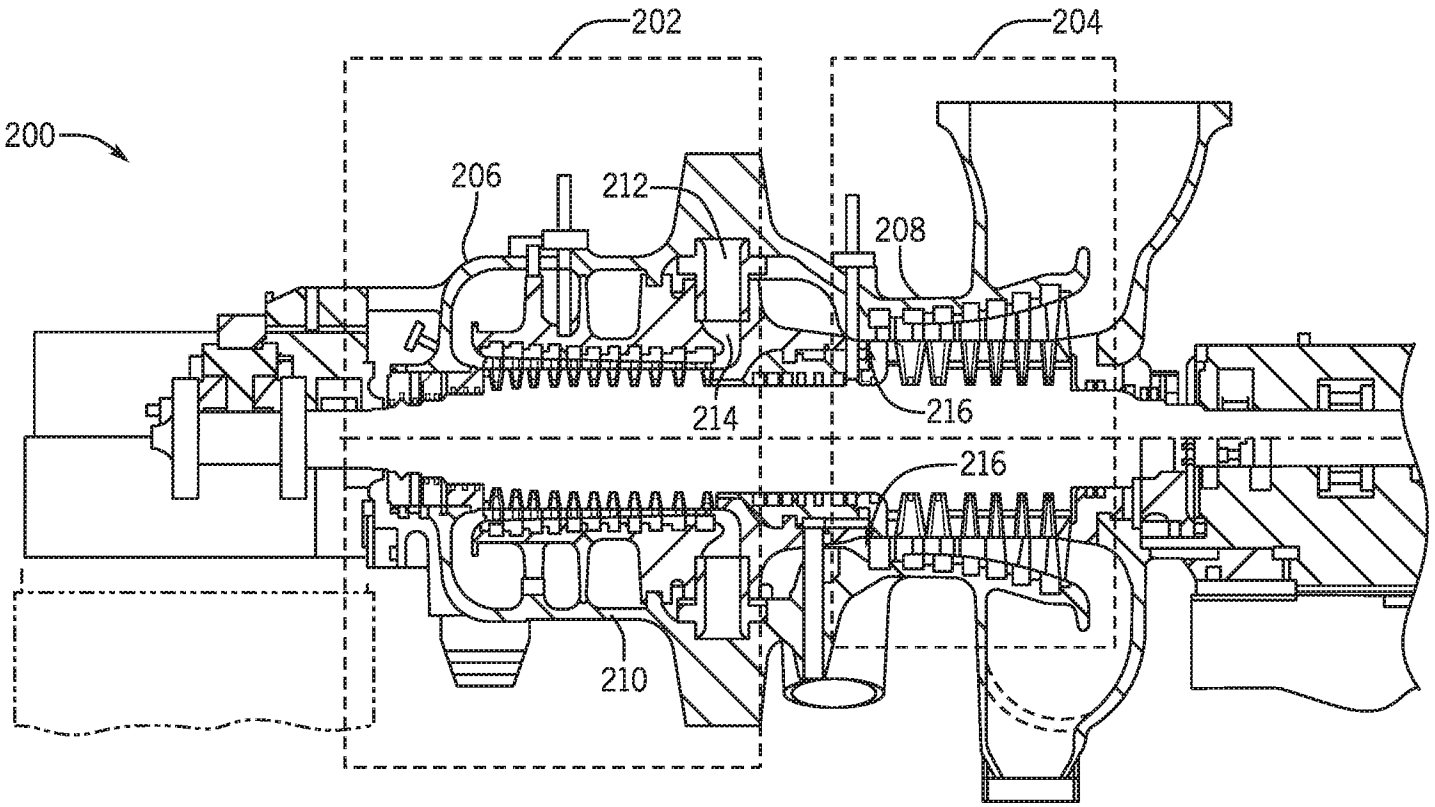
FIG. 1 is cross-sectional side view of an embodiment of a steam turbine.

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure include a support system for assembling and shipping a steam turbine (e.g., high pressure module and/or intermediate pressure module). The support system provides a unique means to axially lock a rotor of a steam turbine in place during the building and shipping of the steam turbine module as described below. The steam turbine module includes the rotor disposed within a casing or shell. The support system includes an annular support fixture coupled to each longitudinal end of the casing. Each annular support fixture includes a first protrusion configured to extend in an axial direction relative to a longitudinal axis of the rotor between the rotor and the casing. The first protrusion provides radial support to the steam turbine module. A shim is disposed between the first protrusion and the casing. Each annular support fixture also includes a second protrusion that extends in a radial direction relative to the longitudinal axis toward a lateral surface of the rotor. The second protrusion includes a surface configured to face the rotor in the axial direction. The support system also includes a respective block (e.g., annular ring) disposed between the surface of the second protrusion of each respective annular support fixture and the rotor. The blocks constrain movement of the rotor in the axial direction during shipping of the steam turbine module. In certain embodiments, each annular support fixture, each block, and the casing include multiple segments.

The support system supports a turbine rotor in a shell or casing and enables turbine assembly to be completed. The support system remains in place to fix the rotor position both axially and radially enabling shipping of the turbine assembly. This support system eliminates the need for additional shipping brackets to secure the rotor during transport. During the assembly process, the support system supports the rotor and avoids the need for temporary bearings, thus providing both a cost and time saving for assembly of the turbine. During preparation for shipment, the support system is accessible at a location external to the turbine eliminating the need to machine, form, weld, and internally install guide plates. Advantageously, the support system increases the axial contact area on the rotor (e.g., 360 in a circumferential direction about the rotor), while also reducing the axial clearance or gap between the support system and the rotor. Both reduce the potential damage from relative motion of the rotor during shipping. Additionally, due to the support system's external accessibility relative to the turbine, breaking the pressure containment boundary to complete the blind assembly of guide plates is avoided (as well as the introduction of foreign object debris within the steam turbine module). Overall, the combined assembly and shipping support system reduces both the costs and the labor time associated with the assembling and shipping of the steam turbine module.

Turning to the figures, FIG. 1 is a cross-sectional side view of an embodiment of a steam turbine 200 having high-pressure and intermediate-pressure sections 202, 204. The steam turbine 200 may include an outer casing 206, which, in certain embodiments, may be divided into an upper half section 208 and a lower half section 210 with both upper and lower half sections 208, 210 extending around both the high-pressure and intermediate-pressure sections 202, 204 of the steam turbine 200. A central section 212 of the outer casing 206 may include a high-pressure steam inlet 214 through which high-pressure steam may be received by the high-pressure section 202 of the steam turbine 200. Similarly, the central section 212 of the outer casing 206 may also include an intermediate-pressure steam inlet 216 through which intermediate-pressure steam may be received by the intermediate-pressure section 204 of the steam turbine 200.

As described in greater detail below, one or more steam turbine modules (e.g., the high pressure section 202, the low pressure section 204) may be utilized with a support system (e.g., a combined assembly and shipping support system) that supports a turbine rotor in a shell or casing 206 and that fixes the rotor position both axially and radially to enable turbine assembly to be completed. The support system remains in place to enable shipping of the turbine assembly without having to add additional shipping brackets to secure the rotor for transport. As described below, the support system provides a unique means to axially lock the rotor of the steam turbine in place during the building and shipping of the steam turbine module 202, 204. It should be noted that although the support system is described in the context of a steam turbine, it may also be utilized with generators and/or gas turbines.

Figure 2:
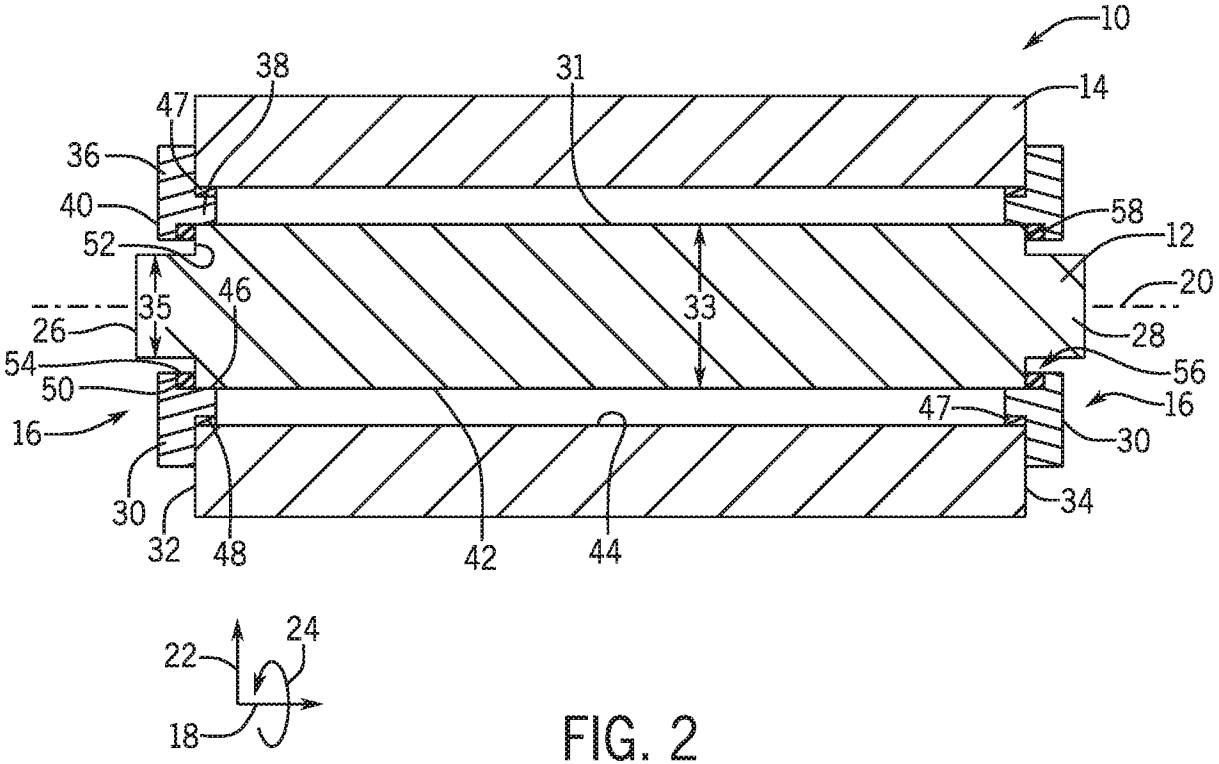
FIG. 2 is a schematic diagram of an embodiment of a steam turbine (e.g., steam turbine module) including a rotor disposed in a casing via a support system.

FIG. 2 is a schematic diagram of an embodiment of a simplified steam turbine 10 (e.g., steam turbine section) including a rotor 12 disposed in a casing 14 (e.g., outer casing) or sleeve via a support system 16 (e.g., combined assembly and shipping support system). The steam turbine section 10 may be a high pressure turbine section (e.g., 202 in FIG. 1), an intermediate pressure turbine section (e.g., 204 in FIG. 1), or a combination thereof. For simplicity, not all components (e.g., seal, blades, etc.) are shown.

For reference, various components may extend in an axial direction 18 (e.g., relative to a longitudinal axis 20 or rotational axis of the rotor 12), a radial direction 22 toward or away from the longitudinal axis 20, and a circumferential direction 24 around the longitudinal axis 20. As depicted, the rotor 12 includes a main portion 31 extending in the axial direction between opposing longitudinal ends 26, 28 of the rotor 12. The main portion 31 includes a diameter 33 that is greater than a respective diameter 35 of the longitudinal ends 26, 28. The casing 14 encloses most of the axial length of the rotor 12 (except the longitudinal ends 26, 28). The casing 14 extends 360 degrees in the circumferential direction 24 about the rotor 12.

During shipping and assembly, the rotor 12 is secured within the casing 14 via the support system 16. The support system 16 is configured to fix the rotor position within the casing 14 in both the axial direction 18 and the radial direction 22 during both assembly and shipping of the steam turbine section 10. The support system 16 includes a support fixture 30 (e.g., annular support fixture) coupled to each longitudinal end 32, 34 of the casing 14 and extend 360 degrees in the circumferential direction 24 around the rotor 12. Each support fixture 30 is coupled to the casing 14 via fasteners (e.g., bolts, screws, etc.).

Each support fixture 30 includes a main body portion 36, a first protrusion 38, and a second protrusion 40. The first protrusion 38 extends in the axial direction 18 between the rotor 12 (e.g., a lateral surface 42 of the rotor 12) and the casing 14 (e.g., an inner surface 44 of the casing 14). The first protrusion 38 provides radial support to the rotor 12. A shim 47 is disposed (e.g., radially 22) between a surface 48 of the first protrusion 38 and the inner surface 44 of the casing 14. The shim 47 is thinner in the radial direction 22 than the first protrusion 38. In particular, a radially inward surface 46 of the first protrusion 38 interfaces (e.g., contacts) with the lateral surface 42 of the rotor 12, while the radially outward surface 48 (opposite the surface 46) of the first protrusion 38 interfaces (e.g., contacts) with the shim 47.

The second protrusion 40 extends in the radial direction 22 toward the lateral surface 42 of the rotor 12. The second protrusion 40 includes a radially oriented surface 50 that faces the rotor 12 in the axial direction 18 (e.g., an end surface 52 of the main portion 31 of the rotor 12 that extends in the radial direction 22).

The support system 16 includes a block 54 (e.g., an annular ring or plate) disposed adjacent each longitudinal end 26, 28 of the rotor 12. In particular, each block 54 is disposed within a gap 56 between the rotor 12 and the support fixture 30. The gap 56 is defined between the radially oriented surface 50 of the second protrusion 40 of the support fixture 30 and the end surface 52 of the rotor 12. In certain embodiments, the radially oriented surface 50 of the second protrusion 40 and the end surface 52 of the rotor 52 may be parallel to one another.

As described in greater detail below, the block 54 may be machined to fit within the gap 56. In certain embodiments, a surface 58 of the block 54 is configured to interface with the end surface 52 of the rotor 12 around an entirety of the rotor 12 (that is, extending 360 degrees in the circumferential direction 24). When the block 54 is installed, a distance between the surfaces 52, 58 may range from 0.00 mm to 0.16 mm. In certain embodiments, the distance between the surfaces 52, 58 is less than 0.16 mm. The block 54 stops or keeps the rotor 12 from moving in the axial direction 18 during shipping of the steam turbine section 10. The block 54 may be made of a softer material (e.g., steel) than the rotor 12 to minimize any potential damage to the rotor 12.

As noted above, the support system 16 supports the turbine rotor 12 in the shell or casing 14 and enables turbine assembly to be completed. The support system 16 remains in place to fix the rotor position both axially 18 and radially 22, thereby enabling shipping of the turbine assembly 10. This support system 16 eliminates the need for additional shipping brackets to secure the rotor 12 during transport. During the assembly process, the support system 16 supports the rotor 12 and avoids the need for temporary bearings providing both a cost and time saving for assembly of the turbine 10. During preparation for shipment, the support system 16 is accessible at a location external to the turbine 10, which eliminates the need to machine, form, weld, and internally install guide plates.

Advantageously, the support system 16 increases the axial contact area on the rotor 12 (e.g., 360 in a circumferential direction 24 about the rotor 12), while also reducing the axial clearance or gap between the support system 16 and the rotor 12. Both reduce the potential damage from relative motion of the rotor 12 during shipping. Additionally, due to the external accessibility of the support system 16 relative to the turbine 10, breaking the pressure containment boundary to complete the blind assembly of guide plates is avoided (as well as the introduction of foreign object debris within the steam turbine module 10). Overall, the combined assembly and shipping support system 16 reduces both the costs and the labor time associated with the assembling and shipping of the steam turbine module 10.

Figure 3:
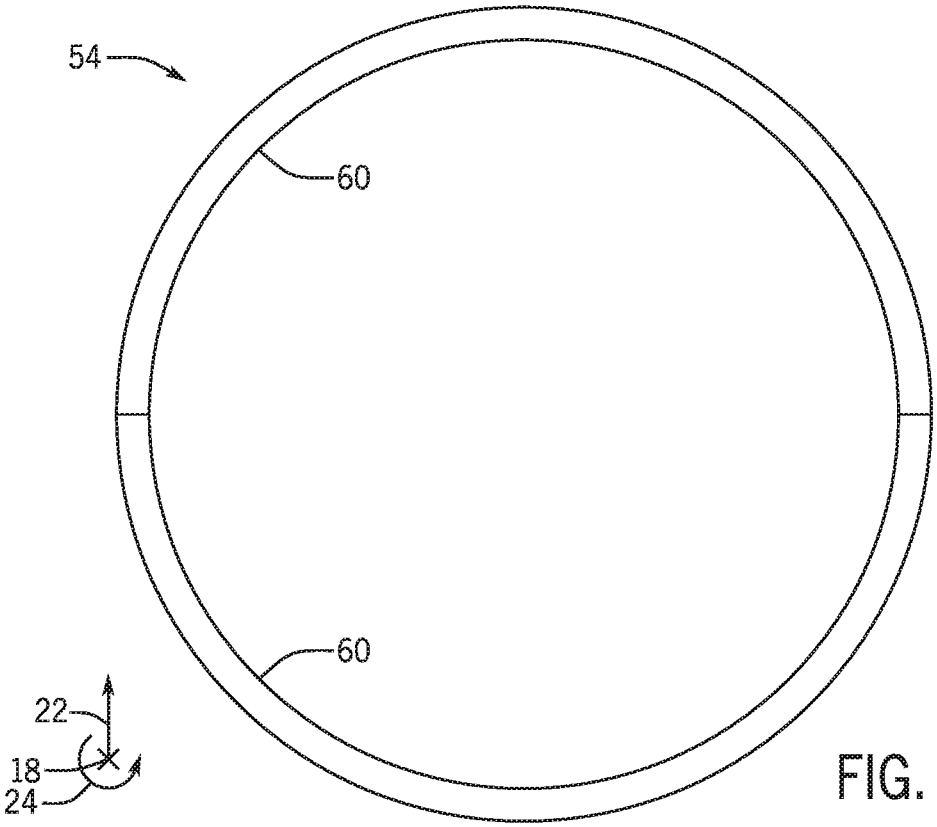
FIG. 3 is a front view of an embodiment of a block (e.g., annular ring) of the support system of FIG. 2.

The casing 14, each support fixture 30, and each block 54 may be assembled from a plurality of segments. FIG. 3 illustrates an embodiment of the block 54 (e.g., an annular ring or plate). The block 54 is as described above. As depicted, the block 54 includes two segments 60 that form the annular shape of the block 54. In certain embodiments, the number of segments 60 that form the block 54 may vary (e.g., 2, 3, 4, or more).

Figure 4:
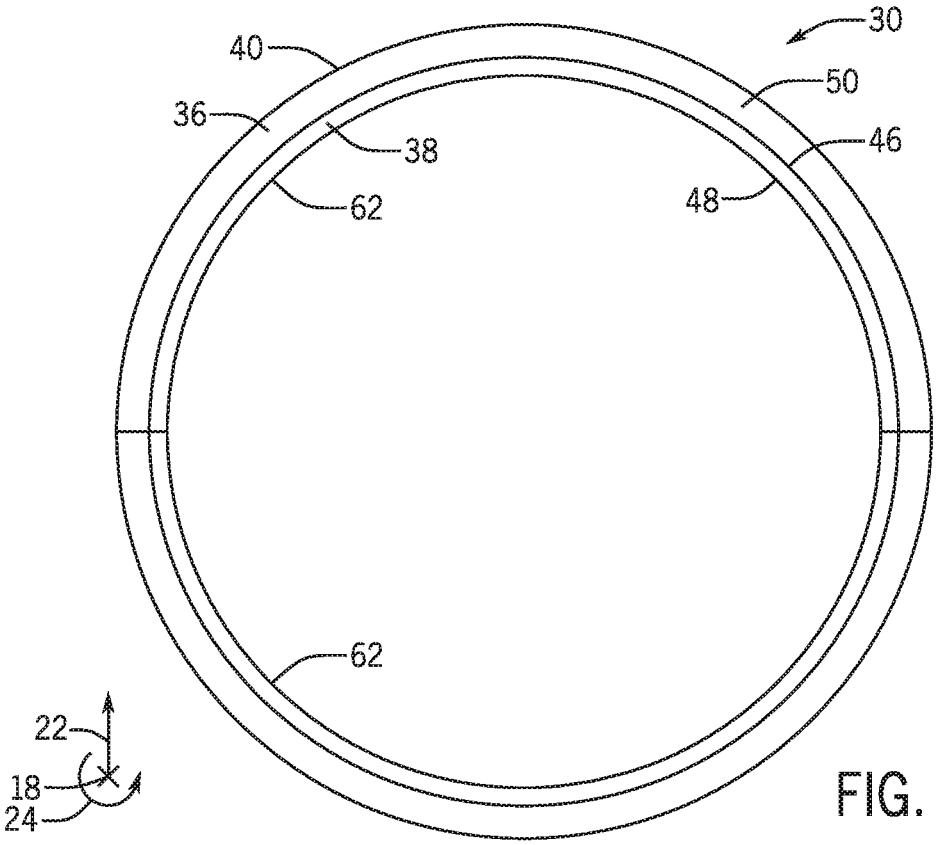
FIG. 4 is a rear view of an embodiment of an annular support fixture of the support system of FIG. 2.

FIG. 4 illustrates an embodiment of the support fixture 30 (e.g., an annular support fixture). The support fixture 30 is as described above. As depicted, the support fixture 30 includes two segments 62 that form the annular shape of the support fixture 30. In certain embodiments, the number of segments 62 that form the support fixture 30 may vary (e.g., 2, 3, 4, or more). The number of segments 62 for the support fixture 30 may or may not correspond to the number of segments 60 of the block 54. As discussed below, the casing 14 may include two segments (e.g., a lower half and an upper half).

Figure 5:
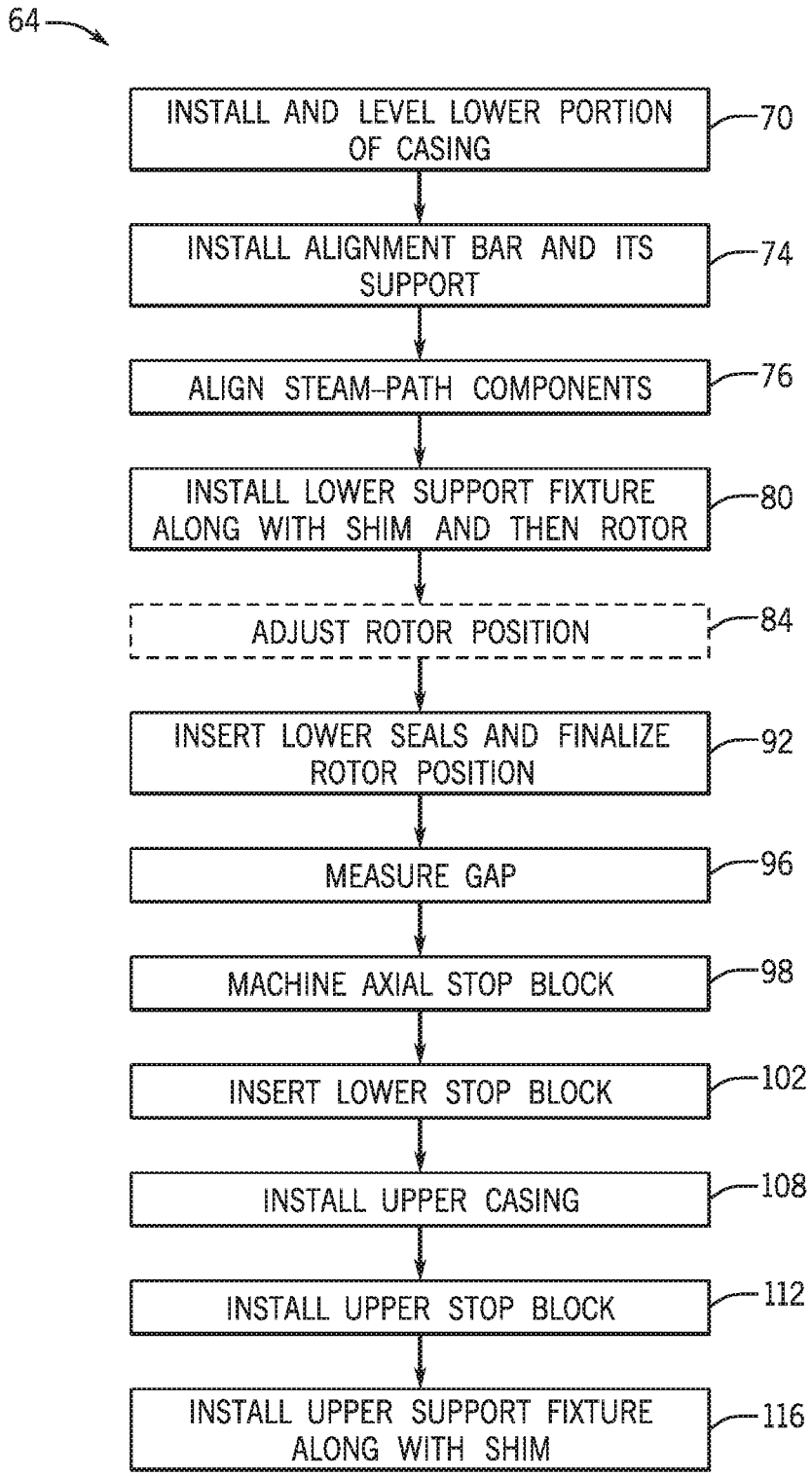
FIG. 5 is a flow diagram of an embodiment of a method for assembling the steam turbine module with the support system of FIG. 2.

FIG. 5 is a flow diagram of an embodiment of a method 64 for assembling the steam turbine section 10 with the support system 16 of FIG. 2. Various steps of the method 64 are illustrated in FIGS. 5-9. Some of the steps of the method 64 may be performed in a different order or simultaneously. Although only one end of the steam turbine section 10 is illustrated in FIGS. 5-9, the various steps of the method 64 apply to both ends of the rotor 12 and the casing 14. Although the following discussion relates to the casing 14, the support fixture 30, and the block 54 each having two segments, as noted above, the support fixture 30 and the block 54 may each include more than two segments. In addition, the following discussion refers to the segments in terms of upper and lower relative to a centerline of the steam turbine section 10. In addition, only a portion of the rotor 12 and the casing 14 are shown in FIGS. 5-9.

Figure 6:
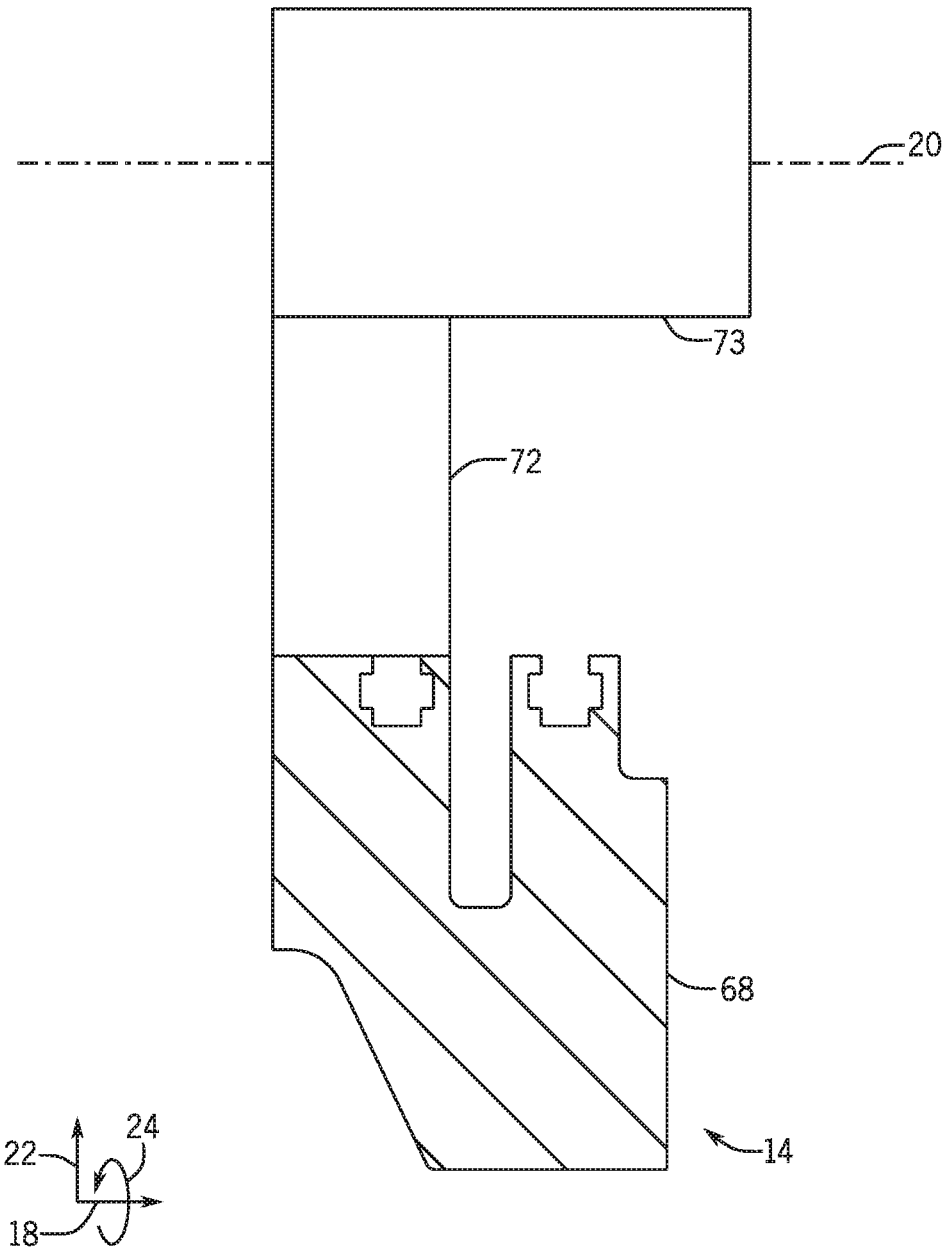
FIGS. 6-10 are cross-sectional diagrams illustrating the assembly of the steam turbine module with the support system of FIG. 2.

The method 64 includes installing and leveling a lower portion 68 of the casing 14 (block 70) followed by inserting an alignment bar support 72 and an alignment bar 73 (block 74), as depicted in FIG. 6. The method 64 then includes aligning the various steam-path components (block 76).

Figure 7:
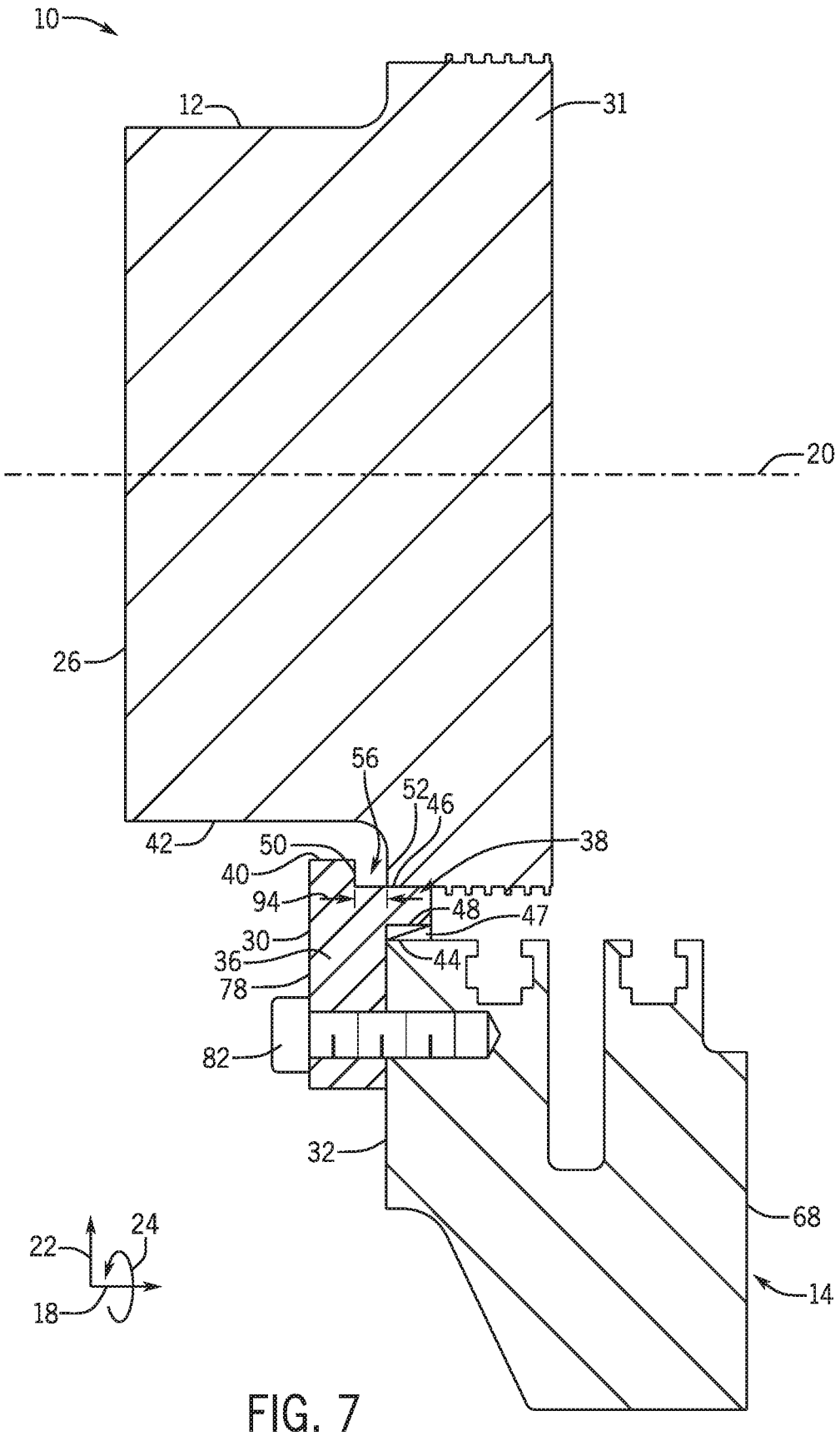
Figure 8:
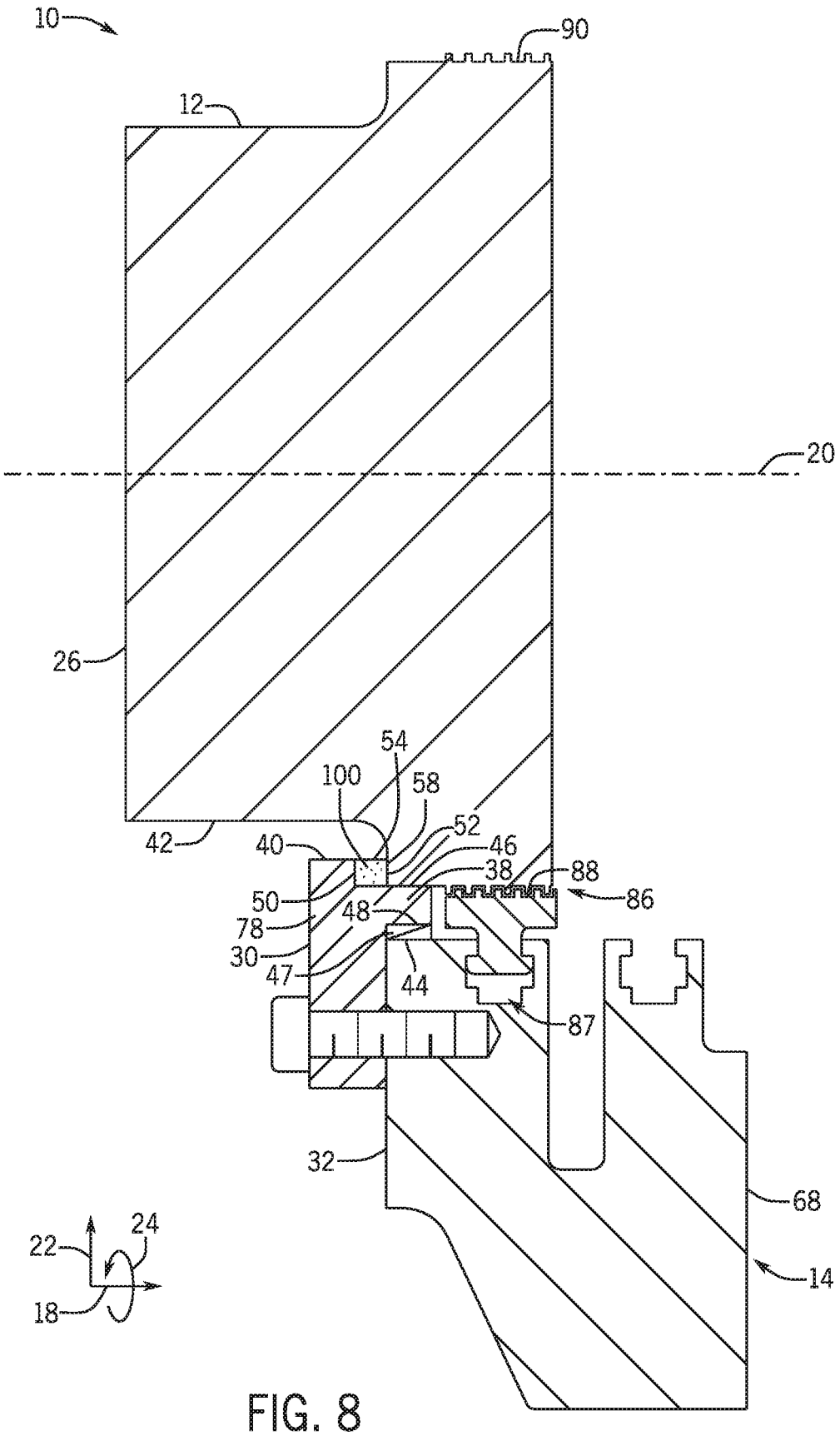

The method 64 includes installing a lower portion 78 of the support fixture 30 along with the shim 47 to the longitudinal end 32 of the lower portion 68 of the casing 14, followed by installing the rotor 12 in its initial position (block 80) as depicted in FIG. 7. The shim 47 is installed between the surfaces 44, 48. A thickness of the shim 47 in the radial direction 22 may vary. In certain embodiments, the thickness of the shim 47 may be 0.2032 mm (0.008 inches). In particular, the lower portion 78 of the support fixture 30 is fastened to the longitudinal end 32 of the casing 14 via a plurality of fasteners 82 (e.g., bolts, screws, etc.) spaced apart from each other in the circumferential direction 24. In certain embodiments, the method 64 includes measuring the rotor position and adjusting, as necessary, the rotor position (e.g., via adjusting the shim 47) (block 84). As depicted in FIG. 8, the method 64 further includes inserting (rolling in) lower seals 86 of annular seals into slots 87 of the lower portion 68 of the casing 14 so that the seal teeth 88 interface with annular rotor lands 90 extending radially 22 from the rotor 12 (block 92) and finalizing the rotor position.

The method 64 then includes measuring a distance 94 of the gap 56 (see FIG. 7) (block 96). In particular, the axial distance 94 between the surface 50 of the second protrusion 40 and the end surface 52 of the rotor 12 is measured. Upon measuring the axial distance 94 of the gap 56, the method 64 includes machining (e.g., grinding) the block 54 to fit within the gap 56 with minimal clearance between the surface 58 of the block 54 and the end surface 52 of the rotor 12 to enable assembly (block 98). The method 64 includes inserting a lower portion 100 of the block 54 circumferentially 24 into the gap 56 (block 102) (see FIG. 8).

Figure 9:
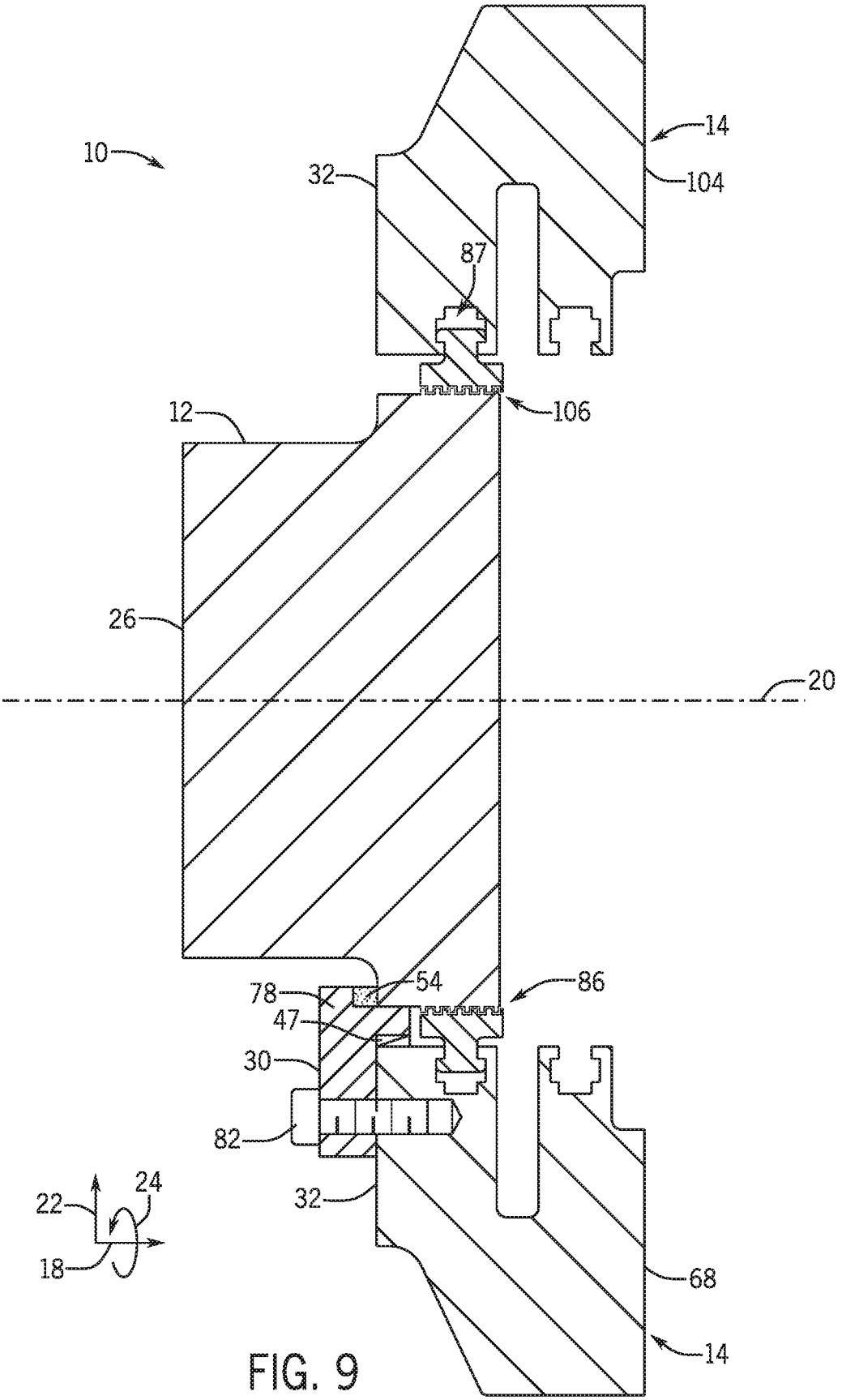
Figure 10:
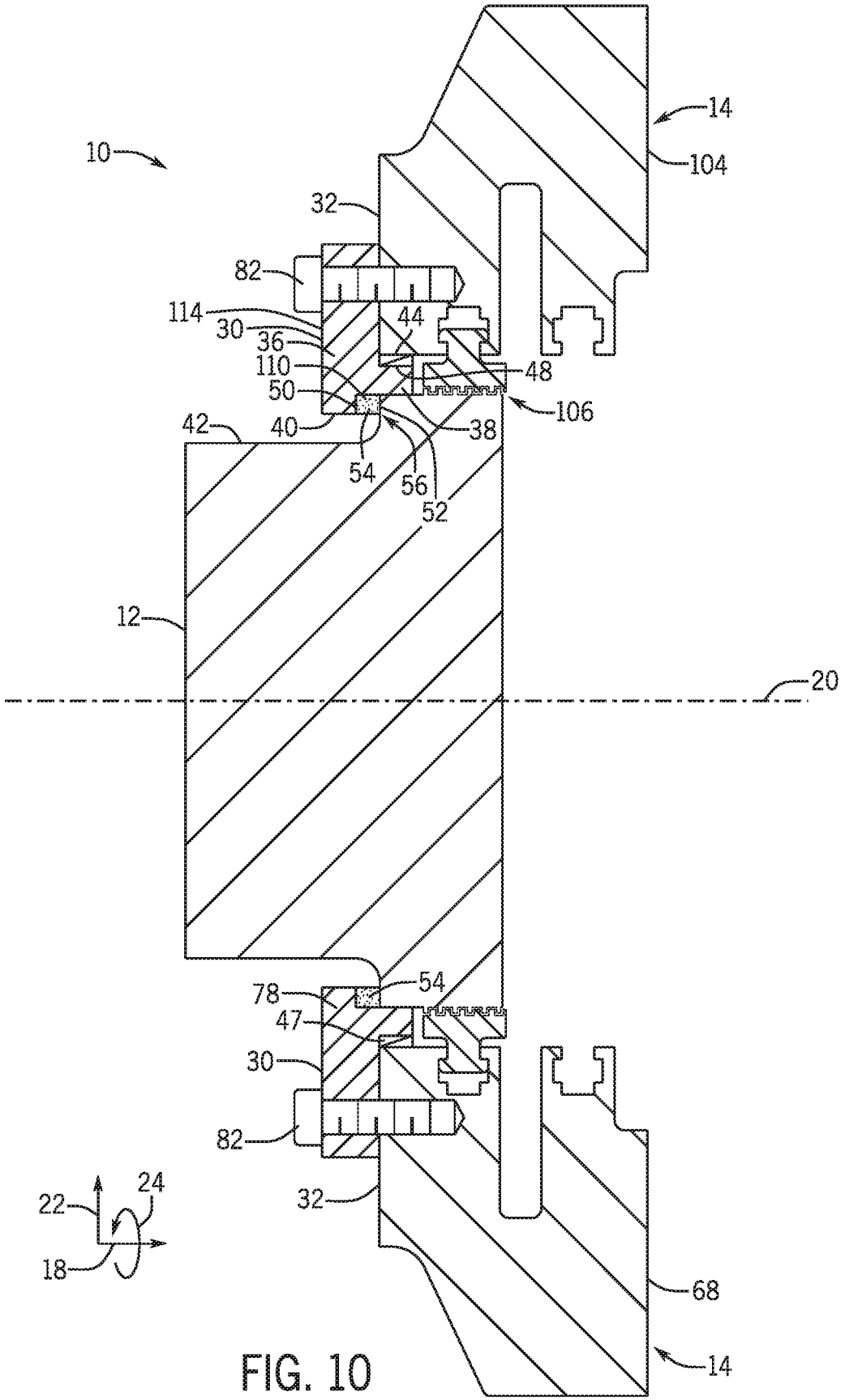

The method 64 further includes inserting upper seals 106 of the annular seals into slots 87 of the upper portion 104 of the casing 14 (block 108) and then installing an upper portion 104 of the casing 14 (see FIG. 9). The method 64 then includes inserting an upper portion 110 of the block 54 circumferentially 24 into the gap 56 to complete the block 54 (block 112) (see FIG. 10). After inserting the upper portion 110 of the block 54, the method 64 includes installing an upper portion 114 of the support fixture 30 along with another shim 47 to the longitudinal end 32 of the upper portion 104 of the casing 14 to complete the annular support fixture 30 (block 116) (see FIG. 10). In certain embodiments, another shim 47 may not be installed with the upper portion 114 of the support fixture 30. In particular, the upper portion 114 of the support fixture 30 is fastened to the longitudinal end 32 of the casing 14 via a plurality of fasteners 82 (e.g., bolts, screws, etc.) spaced apart from each other in the circumferential direction 24. Upon insertion of the upper portion 114 of the support fixture 30, the support fixture 30 is torqued to a desired specification and the steam turbine section 10 is ready for shipping.

Technical effects of the disclosed embodiments include providing a support system for both assembling and shipping of a steam turbine module or section. A support system supports a turbine rotor in a shell or casing and enables turbine assembly to be completed. The support system remains in place to fix the rotor position both axially and radially, thus enabling shipping of the turbine assembly. This support system eliminates the need for additional shipping brackets to secure the rotor during transport. During the assembly process, the support system supports the rotor and avoids the need for temporary bearings, which provides both a cost and time saving for assembly of the turbine. During preparation for shipment, the support system is accessible at a location external to the turbine, thereby eliminating the need to machine, form, weld, and internally install guide plates. Advantageously, the support system increases the axial contact area on the rotor (e.g., 360 degrees in a circumferential direction about the rotor), while also reducing the axial clearance or gap between the support system and the rotor. Both reduce the potential damage from relative motion of the rotor during shipping. Additionally, due to external accessibility of the support system relative to the turbine, breaking the pressure containment boundary to complete the blind assembly of guide plates is avoided (as well as the introduction of foreign object debris within the steam turbine module). Overall, the combined assembly and shipping support system reduces both the costs and the labor time associated with the assembling and shipping of the steam turbine module.

This written description uses examples to disclose the subject matter, including the best mode, and also to enable any person skilled in the art to practice the subject matter, including making and using any devices or systems and performing any incorporated methods. The patentable scope of the subject matter is defined by the claims and may include other examples that occur to those skilled in the art. Such other examples are intended to be within the scope of the claims, if they have structural elements that do not differ from the literal language of the claims, or if they include equivalent structural elements with insubstantial differences from the literal language of the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112 (f).

The invention claimed is:

1. A system comprising:

a steam turbine module comprising a casing and a rotor disposed within the casing; and a support system for both assembling and shipping the steam turbine module, comprising:

a first annular support fixture coupled to a first longitudinal end of the casing, wherein the first annular support fixture comprises:

a first protrusion that extends in an axial direction relative to a longitudinal axis of the rotor between the rotor and the casing, wherein the first protrusion is configured to support the rotor in a radial direction relative to the longitudinal axis; and a second protrusion that extends in the radial direction toward a lateral surface of the rotor, wherein the second protrusion comprises a first surface facing the rotor in the axial direction; and a block disposed between the first surface of the second protrusion and the rotor, wherein the block is configured to block movement of the rotor in the axial direction during shipping of the steam turbine module, and wherein the block comprises an annular ring.

2. The system of claim 1, wherein the annular ring comprises a plurality of segments.

3. The system of claim 1, wherein the annular ring is configured to contact the rotor 360 degrees about the longitudinal axis.

4. The system of claim 1, wherein the first annular support fixture comprises a shim radially disposed between the first protrusion and an inner surface of the casing.

5. The system of claim 1, wherein the first annular support fixture comprises a plurality of segments.

6. The system of claim 1, wherein the support system comprises a second annular support fixture coupled to a second longitudinal end of the casing opposite the first longitudinal end, wherein the second annular support fixture comprises a third protrusion that extends in the axial direction between the rotor and the casing, and a fourth protrusion that extends in the radial direction toward the lateral surface of the rotor, wherein the fourth protrusion comprises a second surface facing the rotor in the axial direction, and wherein the support system comprises a second block disposed between the second surface of the fourth protrusion and the rotor, wherein the second block is configured to block movement of the rotor in the axial direction during shipping of the steam turbine module, and wherein the second block comprises a second annular ring.

7. A support system for both assembling and shipping a steam turbine module, comprising:

a first annular support fixture configured to be coupled to a first longitudinal end of a casing of the steam turbine module, wherein the first annular support fixture comprises:

a first protrusion configured to extend in an axial direction relative to a longitudinal axis of a rotor of the steam turbine module between the rotor and the casing, wherein the first protrusion is configured to support the rotor in a radial direction relative to the longitudinal axis;

a second protrusion configured to extend in the radial direction toward a lateral surface of the rotor, wherein the second protrusion comprises a first surface configured to face the rotor in the axial direction; and a block configured to be disposed between the first surface of the second protrusion and the rotor, wherein the block is configured to block movement of the rotor in the axial direction during shipping of the steam turbine module, and wherein the block comprises an annular ring.

8. The support system of claim 7, wherein the annular ring comprises a plurality of segments.

9. The support system of claim 8, wherein the plurality of segments comprises a first segment coupled to a lower portion of the casing and a second segment disposed against an upper portion of the casing.

10. The support system of claim 7, wherein the annular ring is configured to contact the rotor 360 degrees about the longitudinal axis.

11. The support system of claim 7, wherein the first annular support fixture comprises a shim radially disposed between the first protrusion and an inner surface of the casing.

12. The support system of claim 7, wherein the first annular support fixture comprises a plurality of segments.

13. The support system of claim 7, comprising a second annular support fixture configured to couple to a second longitudinal end of the casing opposite the first longitudinal end, wherein the second annular support fixture comprises a third protrusion configured to extend in the axial direction between the rotor and the casing, wherein the third protrusion is configured to support the rotor in the radial direction, and a fourth protrusion configured to extend in the radial direction toward the lateral surface of the rotor, wherein the fourth protrusion comprises a second surface configured to face the rotor in the axial direction, and wherein the support system comprises a second block configured to be disposed between the second surface of the fourth protrusion and the rotor, wherein the second block is configured to block movement of the rotor in the axial direction during shipping of the steam turbine module, and wherein the second block comprises a second annular ring.

14. The support system of claim 13, wherein the second annular ring comprises a plurality of segments.

15. A method for assembling and shipping a steam turbine module, the method comprising:

coupling a first portion of a first annular support fixture to a first longitudinal end of a lower portion of a casing of the steam turbine module, wherein the first annular support fixture comprises a first protrusion that is configured to extend in an axial direction relative to a longitudinal axis of a rotor of the steam turbine module between the rotor and the casing and a second protrusion that is configured to extend in a radial direction relative to the longitudinal axis toward a lateral surface of the rotor, wherein the second protrusion comprises a surface configured to face the rotor in the axial direction, and wherein the first protrusion is configured to support the rotor in the radial direction;

disposing a rotor of the steam turbine module within the lower portion of the casing; and disposing a first portion of a block between the surface of the second protrusion and the rotor, wherein the first portion of the block is configured to block movement of the rotor in the axial direction during shipping of the steam turbine module.

16. The method of claim 15, comprising:

disposing an upper portion of the casing over the rotor and the lower portion of the casing;

coupling a second portion of the first annular support fixture to the first longitudinal end of the upper portion of the casing of the steam turbine module; and disposing a second portion of the block against the rotor and adjacent the upper portion of the casing, wherein the second portion of the block is disposed between the surface of the second protrusion and the rotor, and wherein the second portion of the block is configured to block movement of the rotor in the axial direction during shipping of the steam turbine module.

17. The method of claim 15, comprising determining a distance of a gap between the surface of the second protrusion and the rotor and machining the first portion of the block to fit within the gap.

18. The method of claim 15, wherein the first annular support fixture comprises an annular ring.

* * * * *